United States Patent [19]

Beam

[11] Patent Number: 4,586,710

[45] Date of Patent: May 6, 1986

[54] LOTTERY SELECTION DEVICE

[76] Inventor: Thomas E. Beam, 206 Pembroke Dr., Shillington, Pa. 19607

[21] Appl. No.: 611,943

[22] Filed: May 18, 1984

[51] Int. Cl.[4] ..... A63F 3/00

[52] U.S. Cl. ..... 273/138 A; 273/148 R

[58] Field of Search ..... 273/1 E, 237, 269, 270, 273/274, 285, 287, 138 A, 148 R; 434/364, 363; 33/562

[56] References Cited

U.S. PATENT DOCUMENTS

| | | | |
|---|---|---|---|
| 2,206,865 | 6/1940 | David et al. . | |
| 2,294,444 | 9/1942 | Boroughs . | |
| 3,984,107 | 10/1976 | Nelson | 273/269 |
| 4,151,404 | 4/1979 | Harrington et al. . | |
| 4,188,775 | 2/1980 | Fatton . | |
| 4,228,596 | 10/1980 | Daniel | 273/237 |
| 4,421,314 | 12/1983 | Stancill | 273/285 |

FOREIGN PATENT DOCUMENTS

| | | | |
|---|---|---|---|
| 2105996 | 4/1983 | United Kingdom | 273/269 |

*Primary Examiner*—Richard C. Pinkham

*Assistant Examiner*—Vincent A. Mosconi

*Attorney, Agent, or Firm*—Sixbey, Friedman & Leedom

[57] ABSTRACT

A lottery selection device which is portable, lightweight and compact, so that it may be readily carried in a pocket or pocketbook of a player, yet will provide a hard surface upon which the lottery card can be marked while the player is waiting in line, as well as facilitate viewing of the numbers in the entry boxes and filling in of the desired choices. A preferred embodiment is disclosed, which is comprised of a base member within which a lottery card receiving slot and grid overlay are provided, and which provides a hard surface for supporting the card and a stencil framing the entry boxes. The support surface of the lottery card receiving slot is transparent and overlies an illumination source, so that the entry boxes and the numbers therein can be made more visible. To help the player decide on what numbers to select, a random number generating circuit and display is built into the base, whereby the player can generte random numbers of a desired number of digits, which can then be marked on the card.

17 Claims, 5 Drawing Figures

LOTTERY SELECTION DEVICE

BACKGROUND OF THE INVENTION

The present invention relates to a lottery selection device which can be utilized by players of various state-run lotteries and the like for use in making their selections on the prescribed lottery card.

In particular, the present invention is directed to eliminating problems faced by players in (1) finding a hard surface to write on while waiting in line; (2) viewing the numbers in the entry boxes, particularly when the printing is in a light color, such as red; (3) filling in the small entry boxes; and (4) deciding what numbers to play.

An apparatus is known from U.S. Pat. No. 3,874,548, whereby a person can make a forecast and place an appropriate stake on sporting events and games of chance, such as bingo. This prior art apparatus is a free-standing, coin operated machine, which automatically marks a specific type of card with the selections of a person that have been chosen on a selection panel. However, such an apparatus is expensive and is not suitable as a unit that can be carried by a person in their pocket or pocketbook, is not designed for facilitating manual marking of a lottery card, and has no facility for providing assistance to a player in deciding what numbers to play.

Random number generators, per se, are well-known, which can be used for various recreational and amusement apparatus, examples being found in U.S. Pat. Nos. 4,151,404 and 4,188,779. However, applicant is unaware of any adaptation of such known devices for use in a lottery selection device of the type to which the present invention is directed.

Furthermore, while portable, illuminated transparency viewers are known from patents such as U.S. Pat. No. 2,294,444 and U.S. Pat. No. 2,206,865, such viewers are not suitable for use with typical lottery cards and are not constructed to facilitate viewing and marking of such lottery cards.

SUMMARY OF THE INVENTION

In view of the foregoing, it is a primary object of the present invention to provide a lottery selection device which is portable, lightweight and compact, so that it may be readily carried in a pocket or pocketbook of a player, yet will provide a hard surface upon which the lottery card can be marked while the player is waiting in line, as well as facilitate viewing of the numbers in the entry boxes and filling in of the desired choices.

As a further object of the present invention, it is desired to provide a lottery selection device which will enable the player to decide what numbers to play.

The above objects, and others, are achieved in accordance with a preferred embodiment of the present invention, which is comprised of a base member within a lottery card receiving slot and grid overlay are provided, and which provides a hard surface for supporting the card and a stencil framing the entry boxes. The support surface of the lottery card receiving slot is transparent and overlies illumination means, so that the entry boxes and the numbers therein can be made more visible. To help the player decide on what numbers to select, a random number generating circuit and display is built into the base, whereby the player can generate random numbers of a desired number of digits, which can then be marked on the card.

As a further aid to lottery players, the grid overlay can be a replaceable member, so that the device can be adapted to any number of different card formats. Furthermore, a lid may be provided for covering the base that has, on its underside, clips for retaining a writing implement, such as a pencil or pen, and a pocket within which lottery cards or receipts can be stored.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
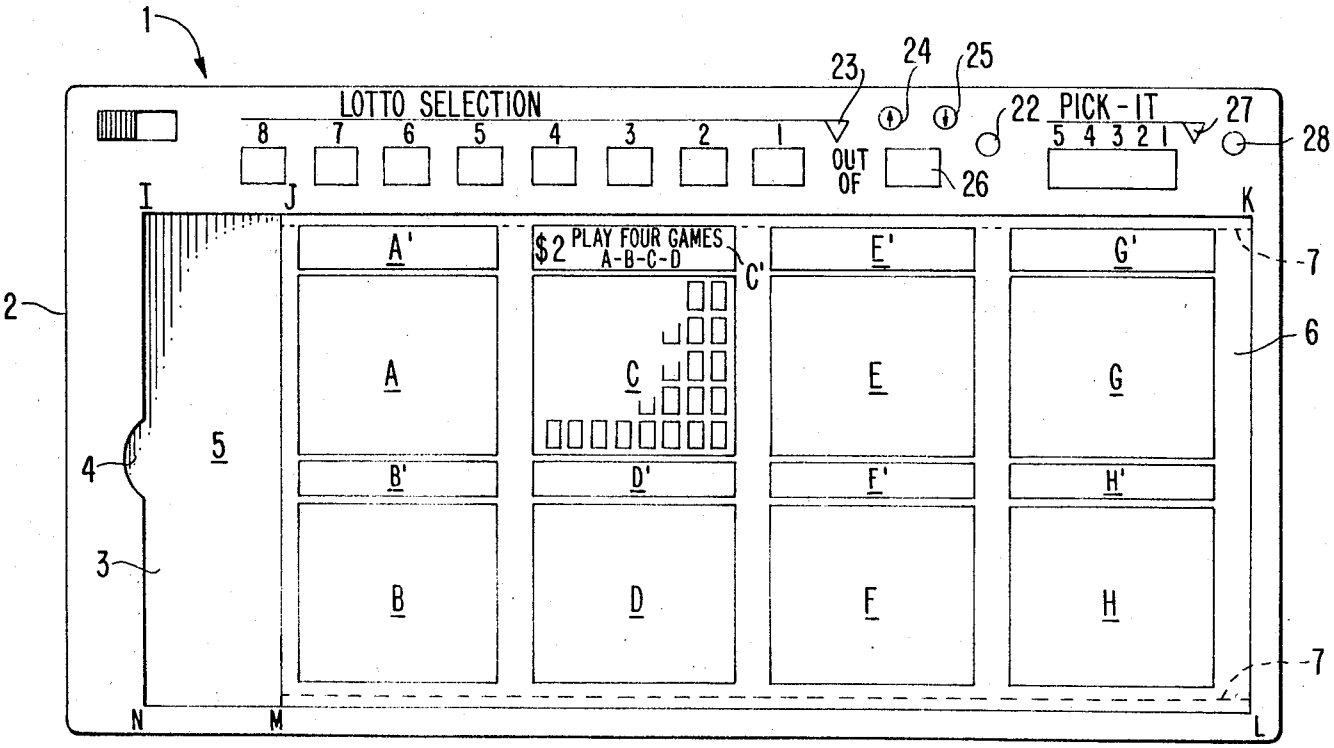
FIG. 1 is a top plan view of a base section of a lottery selection device in accordance with a preferred embodiment of the present invention.

With reference to FIG. 1, it is noted that the lottery selection device, indicated generally by reference numeral 1, has as its primary component, a rigid base member 2 that may be formed, preferably, of high impact, injection molded plastic. Formed into the top of the base 2 is a rectangular recess 3 extending between points I, K, L, N for receiving a lottery game card. The recess 3 is formed with a finger notch 4, for facilitating removal of a card contained in recess 3, and a bottom wall, support surface 5. Bottom wall 5 is opaque in the region bounded by points I, J, M, N, and is transparent in the region bounded by points J, K, L, M.

A detachable stencil or template member 6 is designed to be securely retained over the transparent area J, K, L, M, so as to define a slot, between the underside of the stencil 6 and the walls of the recess 3, which will sufficiently closely conform to the thickness and width dimensions of a typical Lotto-type game card to enable it to be retained in proper position underneath the stencil plate 6, yet provides sufficient clearance for easy insertion and removal of the game card. For supporting the stencil plate 6 above the bottom wall 5 of recess 3, the recess may be provided with longitudinally extending shoulders 7. The fit of the stencil plate 6 within the recess 5 should be snug enough to prevent it from inadvertently falling out, yet it should not be so tight as to impair the ability to substitute one stencil plate for another. Proper positioning of the stencil plate 6 can also be facilitated by provision of complementary detents and recesses at appropriate points on the recess wall and template.

The stencil plate, itself, is provided with a plurality of grid areas, eight grid areas A–H being indicated, as an example. Each of the grid areas A–H will have a pattern of openings corresponding to the small entry boxes found on a Lotto game card for which it is to be utilized, a portion of a $5 \times 8$ grid area of the type which has been used in the Pennsylvania Lotto being shown, for illustration purposes, on grid C. The stencil plate would also be provided with a corresponding number of heading windows A'–H', through which the Lotto card game headings can be viewed. Thus, the stencil plate 6 forms an opaque overlay for the game card that can be used to facilitate appropriate marking of the desired entry boxes when a card is supported upon recess surface 5 underneath the template area.

In order to increase the visibility of the numbers within the entry boxes, a respective lighting means 7–14 (FIG. 2) is disposed underneath each grid area, light from the lighting means travels through the transparent portion of bottom wall 5 to illuminate the entry boxes. Furthermore, inasmuch as the numbers in the entry boxes are often in light colors that are not machine-readable, such as red, to further increase the visibility of the numbers in the entry boxes, the transparent wall portion of support wall 5 has a blue coloring. In this manner, a blue light will be cast upon the numerals in the entry boxes, causing red numerals to appear black. However, it should be appreciated that a clear (colorless) wall portion may be used instead, with or without blue or other color light sources, as may be found desireable based upon the particular cards for which the device is to be primarily used.

Figure 2:
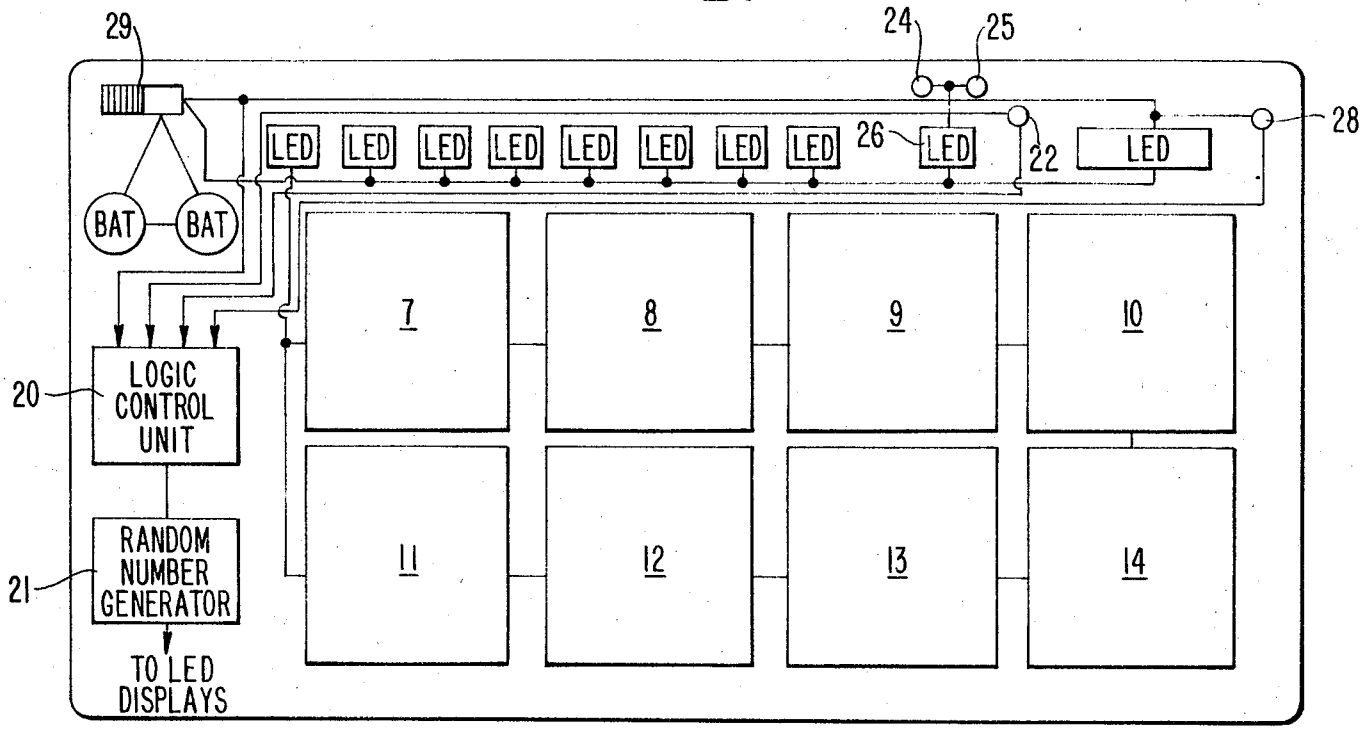
FIG. 2 is a schematic representation of the interior of the base of FIG. 1.

The lighting means 7–14 are merely schematically depicted in FIG. 2, and can be any conventional illuminating means, i.e., light bulbs, edge-lit plate arrangements, etc. The only constraints upon selection of the lighting means are that sufficient light be generated to illuminate a grid area without imposing too great a drain upon the batteries which will be utilized to operate the device, and those imposed upon by the intended size of the device. In this regard, it is anticipated that the base would be no more than approximately 5/16 of an inch thick, and the area to be illuminated would be approximately $6\frac{1}{4}\times3\frac{1}{4}$ inches.

While a basic lottery selection device need be comprised of nothing more than the components described so far, in keeping with the object of providing a means for helping players to decide what numbers to play, the illustrated preferred embodiment is also provided with an entry selection means. In particular, a conventional logic control unit 20 and conventional random number generator 21 are enclosed within the base, and are triggered by, for example, an actuator button 22. A Lotto selector slide 23 may be provided for indicating to the logic unit how many random numbers are to be generated (without replacement) out of a base population (for example, 40 for a $5\times8$ grid as shown in grid C) that may be raised or lowered by activator buttons 24, 25, and is displayed on LED display 26. A "Pick-it" actuator 27 may be provided for setting the number of digits in a single random number (up to five digits, as shown) to facilitate selection of the many daily or weekly "Pick-it" games, and is operated by activator button 28. Random numbers produced by the random number generator are displayed, for example, in respective LED displays shown associated with the Lotto selector 23, and "Pick-it" slide 27.

A switch 29 is provided that, in its off position, deactivates the lottery selection device, as a whole, and, in its on position, actuates the lighting means and supplies power for the number selection means. For providing access for replacement of batteries, light bulbs or servicing, the base member 2 may be formed of top and bottom halves that can be separated for such purposes, or the base 2 may be a one-piece unit having an access panel or panels on its bottom wall, which may be removed to provide access to the interior of the base.

Figure 3:
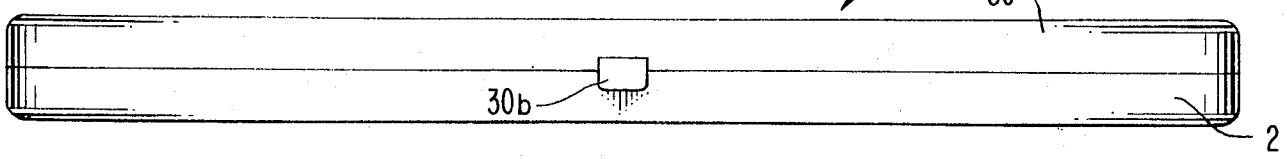
FIGS. 3 and 4 are front and rear elevational views of the preferred embodiment of the lottery selection device in accordance with the present invention.
Figure 4:
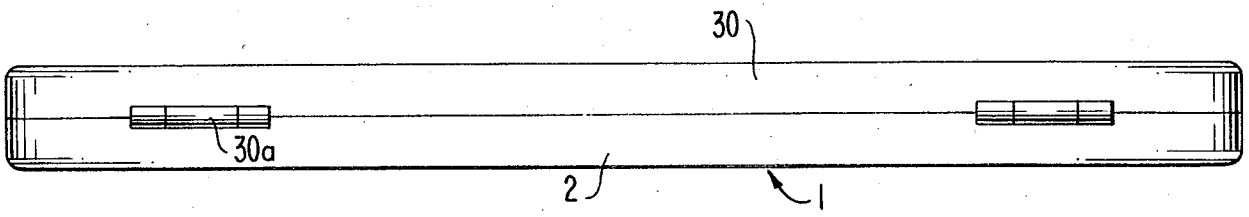
Figure 5:
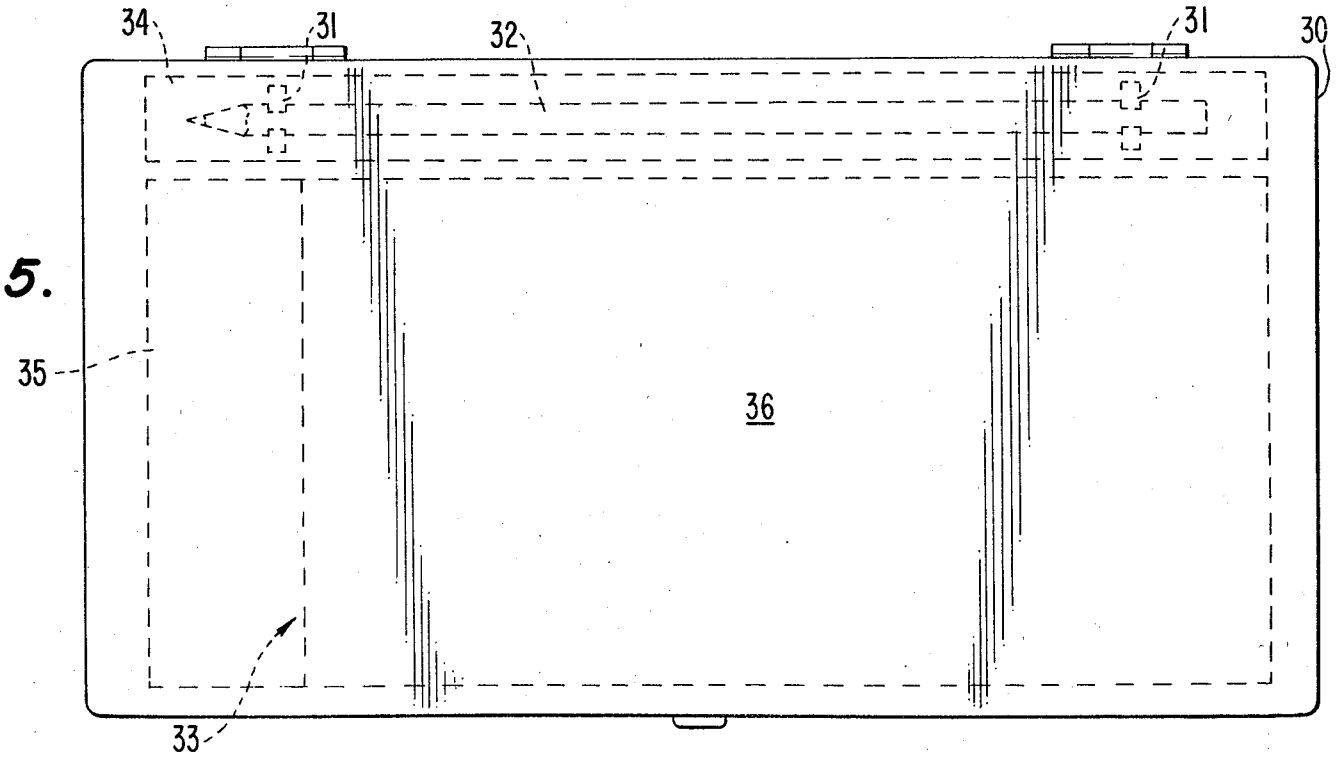
FIG. 5 is a plan view of the lid of the preferred embodiment showing a storage compartment and writing element retaining means.

While the unit described so far forms a complete and operable device capable of achieving all of the objects noted initially, in accordance with the preferred embodiment illustrated herein, a lid 30 is provided. Lid 30 may be formed of the same plastic material as the base and is hinged thereto by way of hinges **30*a* (FIG. 4) that may, advantageously, be unitarily molded parts of the lid and base. Additionally, a clasp 30*b* (FIG. 3) is provided for securing the lid in its closed position covering the top of base 2**. The clasp, and the detents which it engages, may also be unitarily molded portions of the lid and base, respectively.

While a simple cover is sufficient, in accordance with the preferred embodiment, the cover is provided, on its underside, with a pair of clips 31 for retaining a pencil 32, and a pocket, indicated generally as 33, within which extra playing cards or stencils may be stored. In this connection, it is noted that the lid may be a solid piece of plastic within which a recess 34 is provided for receiving the pencil and pencil-retaining clips, as well as a recess 35, which may be partially closed by a vinyl cover 36 for creating the storage compartment. Alternatively, the cover may be dish-shaped, the pencil-retaining clips being secured to its bottom surface and stencil/card storage being provided by projecting flange members, clips or the like.

Even with a lid, the selection device in accordance with the present invention need be no thicker than $\frac{5}{8}$ of an inch, with a width of $4\frac{1}{4}$ inches and a length of 8 inches. Thus, a compact arrangement is achieved that is suitable for carrying in a coat pocket or lady's pocketbook. Furthermore, it should be apparent that the device in accordance with the present invention achieves all of the initially sought objects of providing a surface upon which a lottery card may be marked, while standing in line, which is part of a device that will facilitate viewing of the numbers in the entry boxes, as well as proper filling in of the small entry boxes, in addition to a means for helping the player decide what numbers to play.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A lottery selection device comprising a rigid base member of a size suitable for being held in a person's hand, a lottery card receiving recess being formed in the top of the base member, a stencil member being secured over said recess in a manner enabling detachment thereof for use of another stencil and subsequent reattachment of said stencil for reuse thereof and said stencil having a plurality of grid areas, each grid area being provided with openings of a size and arrangement corresponding to a pattern of entry boxes on a lottery card intended for use with the selection device, said stencil member defining, in conjunction with wall areas of said recess, a slot which sufficiently closely conforms to the thickness and width dimensions of said lottery card intended for use with the selection device as to enable it to be retained in proper position under the stencil with the entry boxes in alignment with the openings of said grid areas, and illumination means located within said base member, below a bottom wall area of said card receiving recess and said grid areas, said bottom wall area being formed of light transmissive material in order to permit light from said illumination means to travel therethrough and illuminate said entry boxes.

2. A lottery selection device according to claim 1, further comprising random number generation means, means for selecting at least one of the type and quantity of numbers produced by said random number generation means, and display means for visually indicating the output of said random number generation means, whereby suggestions of numbers to be marked on lottery cards may be provided.

3. A lottery selection device according to claim 2, wherein said means for selecting comprises means for adjustably setting the quantity of numbers to be selected and displayed.

4. A lottery selection device according to claim 3, wherein said means for selecting comprises means for adjustably selecting the number of digits to be present in a single number to be selected and displayed.

5. A lottery selection device according to claim 2, wherein said means for selecting comprises means for adjustably selecting the number of digits to be present in a single number to be selected and displayed.

6. A lottery selection device according to claim 2, comprising a plurality of said stencil members, each of which has grid areas, each grid area being provided with openings of a size and arrangement corresponding to the size and arrangement of entry boxes of a different lottery card, said stencil members being interchangeably mountable over the card receiving recess.

7. A lottery selection device according to claim 6, further comprising a cover lid for covering the top of said base member.

8. A lottery selection device according to claim 2, further comprising a cover lid for covering the top of said base member.

9. A lottery selection device according to claim 8, wherein said cover lid is provided with means for retaining at least one of a writing implement and extra lottery cards.

10. A lottery selection device according to claim 1, comprising a plurality of said stencil members, each of which has grid areas, each grid area being provided with openings of a size and arrangement corresponding to the size and arrangement of entry boxes of a different lottery card, said stencil members being interchangeably mountable over the card receiving recess.

11. A lottery selection device according to claim 10, further comprising a cover lid for covering the top of said base member.

12. A lottery selection device according to claim 11, wherein said cover lid is provided with means for retaining at least one of a writing element, extra lottery cards, and at least one of said stencil members.

13. A lottery selection device according to claim 1, further comprising a cover lid for covering the top of said base member.

14. A lottery selection device according to claim 13, wherein said cover lid is provided with means for retaining at least one of a writing implement and extra lottery cards.

15. A lottery selection device according to claim 1, comprising means for increasing the visibility of indicia in said entry boxes by altering the apparent coloration thereof.

16. A lottery selection device according to claim 15, wherein the visibility increasing means comprises a coloration of said light transmissive material.

17. A lottery selection device according to claim 16, wherein said coloration is a blue color for causing red indicia to appear black.

* * * * *